US007909945B2

(12) United States Patent
Pieper et al.

(10) Patent No.: US 7,909,945 B2
(45) **Date of Patent: *Mar. 22, 2011**

(54) SOFT MAGNETIC IRON-COBALT-BASED ALLOY AND METHOD FOR ITS PRODUCTION

(75) Inventors: Witold Pieper, Frankfurt (DE); Joachim Gerster, Alzenau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 537 days.

This patent is subject to a terminal disclaimer.

(21) Appl. No.: 11/878,856

(22) Filed: Jul. 27, 2007

(65) Prior Publication Data

US 2009/0145522 A9 Jun. 11, 2009

(30) Foreign Application Priority Data

Oct. 30, 2006 (DE) ..... 10 2006 051 715

(51) Int. Cl.
*H01F 1/147* (2006.01)

(52) U.S. Cl. ..... 148/311; 148/307

(58) Field of Classification Search ..... None
See application file for complete search history.

(56) References Cited

U.S. PATENT DOCUMENTS

| | | | | |
|---|---|---|---|---|
| 2,225,730 | A | | 12/1940 | Armstrong |
| 2,926,008 | A | | 2/1960 | Barnett et al. |
| 2,960,744 | A | | 11/1960 | Blank |
| 3,255,512 | A | | 6/1966 | Lochner et al. |
| 3,337,373 | A | | 8/1967 | Foster et al. |
| 3,401,035 | A | | 9/1968 | Moskowitz et al. |
| 3,502,462 | A | | 3/1970 | Dabkowski et al. |
| 3,624,568 | A | | 11/1971 | Olsen et al. |
| 3,634,072 | A | | 1/1972 | Ackemann et al. |
| 3,977,919 | A | | 8/1976 | Foster et al. |
| 4,059,462 | A | * | 11/1977 | Masumoto et al. ..... 148/306 |
| 4,076,525 | A | | 2/1978 | Little et al. |
| 4,076,861 | A | | 2/1978 | Furukawa et al. |
| 4,120,704 | A | | 10/1978 | Anderson |
| 4,160,066 | A | | 7/1979 | Szumachowski et al. |
| 4,201,837 | A | | 5/1980 | Lupinski |
| 4,601,765 | A | | 7/1986 | Soileau et al. |

(Continued)

FOREIGN PATENT DOCUMENTS

CH 668331 12/1988

(Continued)

OTHER PUBLICATIONS

Witold Pieper et al., "Soft Magnetic Iron-Cobalt Based Alloy and Method for Its Production", German Application No. DE 10 2006 051 715.6, International Filing Date Oct. 30, 2006, U.S. Appl. No. 11/878,856, filed Jul. 27, 2007.

(Continued)

*Primary Examiner* — John P Sheehan
(74) *Attorney, Agent, or Firm* — Buchanan Ingersoll & Rooney PC

(57) ABSTRACT

Disclosed are soft magnetic alloys that consist essentially of 10% by weight ≦Co≦22% by weight, 0% by weight ≦V≦4% by weight, 1.5% by weight ≦Cr≦5% by weight, 1% by weight ≦Mn≦2% by weight, 0% by weight ≦Mo≦1% by weight, 0.5% by weight ≦Si≦1.5% by weight, 0.1% by weight ≦Al≦1.0% by weight, rest iron. Also disclosed are methods of making the alloys, and products containing them, such as actuator systems, electric motors, and the like.

41 Claims, 4 Drawing Sheets

U.S. PATENT DOCUMENTS

| | | | | |
|---|---|---|---|---|
| 4,891,079 | A | 1/1990 | Nakajima et al. | |
| 4,923,533 | A | 5/1990 | Shigeta et al. | |
| 4,950,550 | A | 8/1990 | Radeloff et al. | |
| 4,969,963 | A | 11/1990 | Honkura et al. | |
| 4,994,122 | A | 2/1991 | DeBold et al. | |
| 5,069,731 | A | 12/1991 | Yoshizawa et al. | |
| 5,091,024 | A | 2/1992 | DeBold et al. | |
| 5,200,002 | A | 4/1993 | Hilzinger | |
| 5,202,088 | A | 4/1993 | Genma et al. | |
| 5,261,152 | A | 11/1993 | Simozaki et al. | |
| 5,268,044 | A | 12/1993 | Hemphill et al. | |
| 5,501,747 | A | 3/1996 | Masteller et al. | |
| 5,522,946 | A | 6/1996 | Tomita et al. | |
| 5,534,081 | A | 7/1996 | Takagi et al. | |
| 5,594,397 | A | 1/1997 | Uchikoba et al. | |
| 5,611,871 | A | 3/1997 | Yoshizawa et al. | |
| 5,703,559 | A | 12/1997 | Emmerich et al. | |
| 5,714,017 | A | 2/1998 | Tomida et al. | |
| 5,725,686 | A | 3/1998 | Yoshizawa et al. | |
| 5,741,374 | A | 4/1998 | Li | |
| 5,769,974 | A | 6/1998 | Masteller et al. | |
| 5,804,282 | A * | 9/1998 | Watanabe et al. | 428/141 |
| 5,817,191 | A | 10/1998 | Emmerich et al. | |
| 5,911,840 | A | 6/1999 | Couderchon et al. | |
| 5,914,088 | A | 6/1999 | Rao et al. | |
| 5,922,143 | A | 7/1999 | Verin et al. | |
| 5,976,274 | A | 11/1999 | Inoue et al. | |
| 6,118,365 | A | 9/2000 | Petzold et al. | |
| 6,171,408 | B1 | 1/2001 | Herzer et al. | |
| 6,181,509 | B1 | 1/2001 | Canlas et al. | |
| 6,270,592 | B1 | 8/2001 | Nakajima et al. | |
| 6,373,368 | B1 | 4/2002 | Shikama et al. | |
| 6,462,456 | B1 | 10/2002 | DeCristofaro et al. | |
| 6,507,262 | B1 | 1/2003 | Otte et al. | |
| 6,563,411 | B1 | 5/2003 | Otte et al. | |
| 6,588,093 | B1 | 7/2003 | Emmerich et al. | |
| 6,616,125 | B2 | 9/2003 | Brown et al. | |
| 6,685,882 | B2 | 2/2004 | Deevi et al. | |
| 6,710,692 | B2 | 3/2004 | Kato et al. | |
| 6,749,767 | B2 | 6/2004 | Mitani et al. | |
| 6,942,741 | B2 | 9/2005 | Shimao et al. | |
| 6,946,097 | B2 | 9/2005 | Deevi et al. | |
| 6,962,144 | B2 | 11/2005 | Chretien et al. | |
| 7,128,790 | B2 | 10/2006 | Waeckerle et al. | |
| 7,442,263 | B2 | 10/2008 | Günther et al. | |
| 7,532,099 | B2 | 5/2009 | Brunner | |
| 7,563,331 | B2 | 7/2009 | Petzold et al. | |
| 2002/0062885 | A1 | 5/2002 | Li | |
| 2002/0158540 | A1 | 10/2002 | Lindquist et al. | |
| 2003/0034091 | A1 | 2/2003 | Shimao et al. | |
| 2004/0027220 | A1 | 2/2004 | Günther et al. | |
| 2004/0089377 | A1 | 5/2004 | Deevi et al. | |
| 2004/0099347 | A1 | 5/2004 | Waeckerle et al. | |
| 2004/0112468 | A1 | 6/2004 | Petzold et al. | |
| 2004/0183643 | A1 | 9/2004 | Brunner | |
| 2005/0017587 | A1 | 1/2005 | Koenig | |
| 2005/0268994 | A1 | 12/2005 | Gerster et al. | |
| 2007/0029013 | A1 * | 2/2007 | Waeckerle et al. | 148/311 |
| 2007/0176025 | A1 | 8/2007 | Gerster | |
| 2008/0042505 | A1 | 2/2008 | Gerster et al. | |
| 2008/0099106 | A1 | 5/2008 | Pieper et al. | |
| 2008/0136570 | A1 | 6/2008 | Gerster | |
| 2009/0039994 | A1 | 2/2009 | Pieper et al. | |
| 2009/0184790 | A1 | 7/2009 | Pieper et al. | |

FOREIGN PATENT DOCUMENTS

| | | | |
|---|---|---|---|
| CN | 1185012 | A | 6/1998 |
| DE | 694374 | | 7/1940 |
| DE | 2816173 | | 10/1979 |
| DE | 3324729 | | 1/1984 |
| DE | 3237183 | | 4/1984 |
| DE | 3427716 | | 11/1985 |
| DE | 3542257 | | 6/1987 |
| DE | 4030791 | A1 | 8/1991 |
| DE | 4442420 | A1 | 5/1996 |
| DE | 4444482 | A1 | 6/1996 |
| DE | 19635257 | | 3/1998 |
| DE | 19802349 | A1 | 7/1998 |
| DE | 19844132 | | 4/1999 |
| DE | 19818198 | | 10/1999 |
| DE | 19928764 | A1 | 1/2001 |
| DE | 69611610 | | 7/2001 |
| DE | 10024824 | | 11/2001 |
| DE | 10031923 | A1 | 1/2002 |
| DE | 69903202 | | 6/2003 |
| DE | 10211511 | | 10/2003 |
| DE | 10320350 | | 9/2004 |
| EP | 0216457 | A1 | 4/1987 |
| EP | 0299498 | | 1/1989 |
| EP | 0429022 | | 5/1991 |
| EP | 0271657 | | 5/1992 |
| EP | 0635853 | | 1/1995 |
| EP | 0637038 | | 2/1995 |
| EP | 0715320 | A1 | 6/1996 |
| EP | 0804796 | A1 | 11/1997 |
| EP | 0824755 | B1 | 2/1998 |
| EP | 1124999 | A1 | 8/2001 |
| EP | 0771466 | B1 | 9/2002 |
| EP | 1475450 | A1 | 11/2004 |
| EP | 1503486 | | 2/2005 |
| GB | 833446 | | 4/1960 |
| GB | 1369844 | | 10/1974 |
| JP | 51092097 | A | 2/1975 |
| JP | 54006808 | A | 6/1977 |
| JP | 59058813 | A | 4/1984 |
| JP | 59177902 | | 10/1984 |
| JP | 61058450 | | 3/1986 |
| JP | 61253348 | A | 11/1986 |
| JP | 62-93342 | | 4/1987 |
| JP | 62093342 | A | 4/1987 |
| JP | 1247557 | A | 3/1989 |
| JP | 02301544 | | 12/1990 |
| JP | 03-146615 | | 6/1991 |
| JP | 05283238 | | 10/1993 |
| JP | 05-299232 | | 11/1993 |
| JP | 6033199 | A | 2/1994 |
| JP | 06-224023 | | 8/1994 |
| JP | 08-246109 | | 9/1996 |
| JP | 63021807 | | 1/1998 |
| JP | 10-092623 | | 4/1998 |
| JP | 10-097913 | | 4/1998 |
| JP | 2000-182845 | | 6/2000 |
| JP | 2000-27735 | A | 10/2000 |
| JP | 2000-277357 | A | 10/2000 |
| JP | 2001-068324 | | 3/2001 |
| JP | 2002294408 | A | 3/2001 |
| JP | 2006193779 | A | 7/2006 |
| JP | 2006322057 | A | 11/2006 |
| JP | 2007113148 | | 5/2007 |
| SU | 1062298 | A1 | 7/1982 |
| WO | WO 9619001 | | 6/1996 |
| WO | WO 0100895 | A1 | 1/2001 |
| WO | WO 0186665 | A1 | 11/2001 |
| WO | WO 02/055749 | | 7/2002 |
| WO | WO 03/003385 | | 1/2003 |
| WO | WO 2007/088513 | | 8/2007 |

OTHER PUBLICATIONS

Major and Orrock, "High Saturation Ternary Cobalt-Iron Based Alloys," IEEE Transactions on Magnetics, vol. 24, No. 2, Mar. 1988, pp. 1856-1858.

R. McCurrie, "Ferromagnetic Materials Structure and Properties," Academic Press, pp. 77-78 (1994).

H. Reinboth, "Technologie und Anwendung magnetischer Werkstoffe," Veb Verlag Technik, p. 230 (1969).

A. Taub, "Effect of the heating rate used during stress relief annealing on the magnetic properties of amorphous alloys," J. Appl. Phys. 55, No. 6, Mar. 15, 1984, pp. 1775-1777.

Liu Junxin et Yuqin Qiu: "Heat Treating Method of Nanocrystalline Current Transformer Core".

First Office Action mailed Jan. 7, 2005 issued by the Chinese Patent Office for Chinese Patent Application No. 02809188.4.

Second Office Action mailed Jul. 8, 2005 issued by the Chinese Patent Office for Chinese Patent Application No. 02809188.4.

J. Wünning: "Die Wärmebehandlung in der Fertigungslinie mit einem neuartigen Rollenherdofen," HTM Härterei—Technische Mitteilungen 45 (1990) Nov./Dec., No. 6, pp. 325-329 XP 163038.
Examination Report dated Sep. 24, 2009 for European Publication No. 02 745 429.7-2208.
Liu Junxin et Yuqin Qiu: "Heat Treating Method of Nanocrystalline Current Transformer Core" (English Translation and Certificate of Translation dated Nov. 23, 2009).
H. Reinboth, "Technologie and Anwendung magnetischer Werkstoffe," Veb Verlag Technik, p. 230 (1969) (English Translation and Certificate of Translation dated Nov. 23, 2009).
Examination Report dated Feb. 26, 2003 for German Patent Publication No. 101 34 056.7-33 (English Translation and Certificate of Translation dated Nov. 23, 2009).
German Patent Publication No. 694374 (English Translation and Certificate of Translation dated Nov. 23, 2009).
Chinese Patent Publication No. CN1185012A (English Translation and Certificate of Translation dated Nov. 23, 2009).
Non-Final Office Action dated Jun. 11, 2009 for U.S. Appl. No. 11/663,271.
Non-Final Office Action dated Sep. 22, 2009 for U.S. Appl. No. 11/663,271.
Final Office Action dated Oct. 30, 2009 for U.S. Appl. No. 11/343,558.
Böhler N114 Extra; Nichtrostender Weichmagnetischer Stahl Stainless Soft Magnetic Steel; Böhler Edelstahl GMBH & Co KG; N244 DE EM-WS; 11 pgs.
Carpenter Specialty Alloys; Alloy Data, Chrome Core 8 & 8-FM Alloys and Chrome Core 12 & 12-FM Alloys; Carpenter Technology Corporation; Electronic Alloys; 12 pgs.
Sundar, R.S. et al.; Soft Magnetic FeCo alloys; alloy development, processing, and properties; International Materials Reviews, vol. 50, No. 3, pp. 157-192.
Stahlschlüssel 1958. Marbach: Verlag Stahlschlüssel Wegst GmbH, 1998, Version 2.0, ISBN 3-922599-15-X, Window "Analyse-Suche".
Yoshizawa, Y. et al.; Magnetic Properties of High $B_2$ Nanocrystalline FeCoCuNbSiB Alloys, Advanced Electronics Research Lab, Hitachi Metals, Ltd., 5200 Mikajiri Kumagaya, Japan, 0-7803-9009-1/05/ $20.00 © 2005 IEEE, BR 04.
E. Wolfarth: "Ferromagnetic Materials vol. 2," —Soft Magnetic Materials—p. 73 (1980).
ASM Materials Engineering Dicitonary, Edited by J.R. Davis, Davis & Associates, 1992, p. 2002.
Non-Final Office Action dated Sep. 29, 2008 for U.S. Appl. No. 11/343,558.
Non-Final Office Action dated Apr. 6, 2009 for U.S. Appl. No. 11/343,558.

* cited by examiner

SOFT MAGNETIC IRON-COBALT-BASED ALLOY AND METHOD FOR ITS PRODUCTION

BACKGROUND

1. Field of the Invention

The invention relates to improved soft magnetic iron-cobalt-based alloys, more particularly to improvements to such alloys with a cobalt content of 10 percent by weight (% by weight) to 22% by weight, to methods for the production of such improved alloys, to methods for the production of finished and semi-finished products from these alloys, and to products containing such alloys, in particular magnetic components for actuator systems.

2. Description of Related Art

Soft magnetic iron-cobalt-based alloys have a high saturation magnetisation and can therefore be used in the design of actuator systems with high power and/or a small overall volume. Solenoid valves, for example solenoid valves for fuel injection in internal combustion engines, are a typical application of such alloys.

Certain soft magnetic iron-cobalt-based alloys with a cobalt content of 10% by weight to 22% by weight are, for example, known from U.S. Pat. No. 7,128,790. However, when using these alloys in high-speed actuators, switching frequency can be limited by the eddy currents which are generated. Improvements in the strength of the magnet cores are also desirable in high-frequency actuator systems designed for continuous duty.

SUMMARY

The invention is therefore based on the problem of providing an improved alloy which, by virtue of its novel composition, is better suited for use as a magnet core in high-speed actuators than prior alloys described above.

DETAILED DESCRIPTION OF SPECIFIC EMBODIMENTS

The invention will be more clearly understood by reference to the specific embodiments, which are not intended to limit the scope of the invention, or of the appended claims.

According to the invention, this problem is solved by the subject matter of the independent claims. Advantageous further developments can be derived from the dependent claims.

According to the invention, a soft magnetic alloy consists essentially of 10% by weight≦Co≦22% by weight, 0% by weight≦V≦4% by weight, 1.5% by weight≦Cr≦5% by weight, 1% by weight≦Mn≦2% by weight, 0% by weight≦Mo≦1% by weight, 0.5% by weight≦Si≦1.5% by weight, 0.1% by weight≦Al≦1.0% by weight, rest iron.

Figure 1:
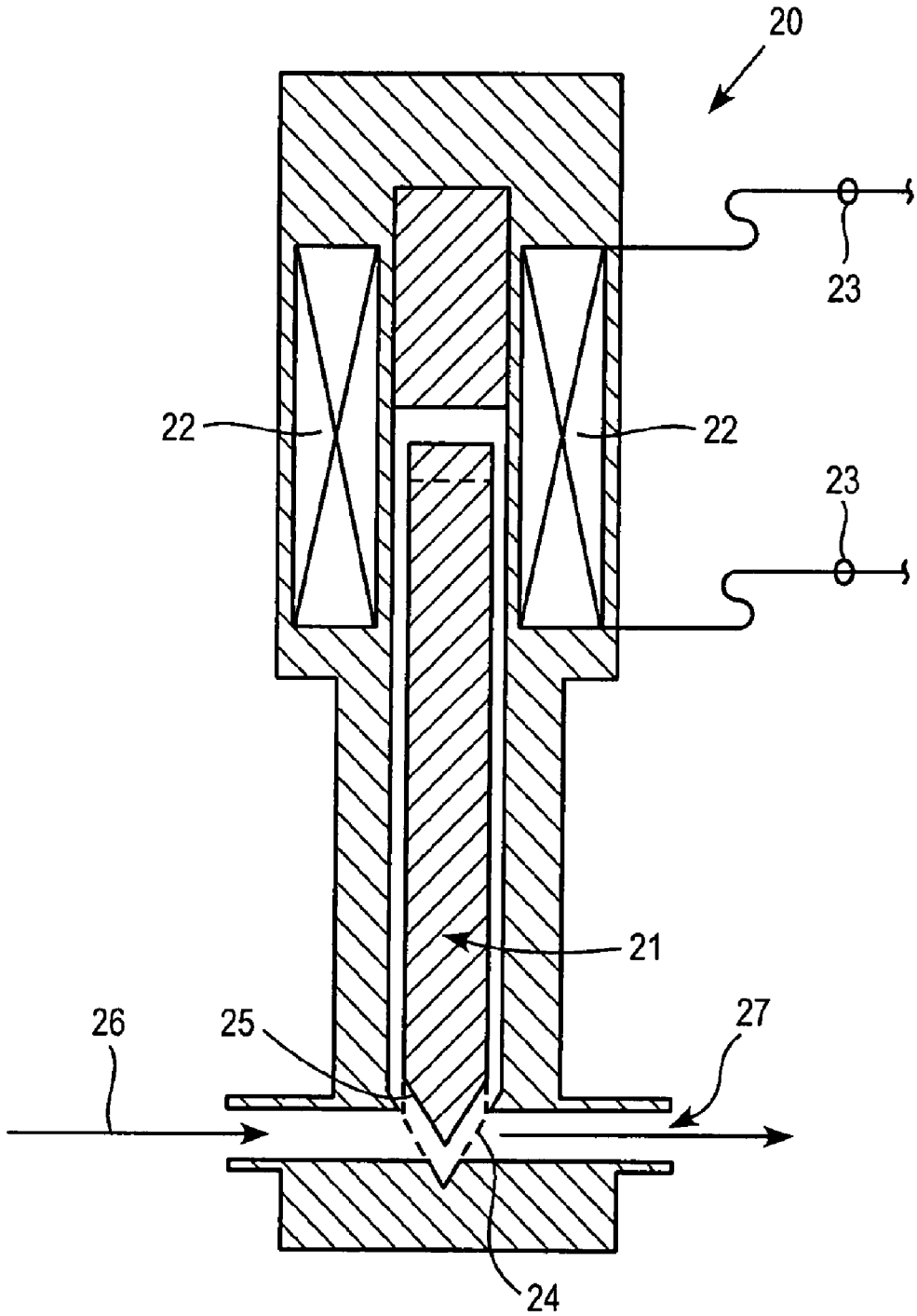
FIG. 1 is a schematic diagram of a solenoid valve with magnetic core made of a soft magnetic alloy according to one embodiment of the invention.

The terms "essentially" and "consisting essentially of" denote that the composition contains the recited components, as well as any impurities which may be present, such as smelting impurities and the like, and any other components that do not affect the basic and novel characteristics of the alloy. The alloy preferably contains a maximum of 200 ppm of nitrogen, a maximum of 400 ppm of carbon and a maximum of 100 ppm of oxygen.

Compared to the binary Co—Fe alloy, the alloy according to the invention has a higher resistivity, resulting in a suppression of eddy currents combined with a minimum reduction of saturation polarisation. This is achieved by the addition of non-magnetic elements. As a result of its Al and Si content, the alloy further has a higher strength. This alloy is suitable for use as a magnet core of a high-speed actuator system, such as in a fuel injector of an internal combustion engine.

Cr and Mn significantly increase resistance while only slightly reducing saturation. At the same time, the annealing temperature, which corresponds to the upper limit of the ferritic phase, is reduced. This is, however, not desirable, as it results in poorer soft magnetic properties.

Al, V and Si likewise increase electric resistance while also increasing the annealing temperature. In this way, an alloy with a high resistance, high saturation and high annealing temperature and thus with good soft magnetic properties can be specified.

As a result of its Al and Si content, the alloy further has a higher strength. The alloy is suitable for cold forming and ductile in the finish-annealed state. The alloy may have an elongation $A_L$>2%, preferably $A_L$>20%. The elongation $A_L$ is measured in tensile tests. This alloy is suitable for use as a magnet core of a high-speed actuator system, such as in a fuel injector of an internal combustion engine.

A soft magnetic cobalt-iron-based alloy for an actuator system is subject to contradictory demands. A higher cobalt content in the binary alloy results in a higher saturation magnetisation $J_s$ of approximately 9 mT per 1% by weight of Co (based on 17% by weight of Co) and therefore permits a reduction in overall volume and increased system integration or higher actuating forces at the same overall volume. At the same time, however, the costs of the alloy increase. As the Co content increases, the soft magnetic properties of the alloy, such as permeability, become poorer. Above a Co content of 22% by weight, saturation is increased less by further Co additions.

The alloy should further have a high resistivity and good soft magnetic properties.

This alloy therefore has a cobalt content of 10% by weight≦Co≦22% by weight. A lower cobalt content reduces the raw material costs of the alloy, making it suitable for applications where costs are of great importance, such as automotive engineering. Maximum permeability is high within this range, resulting in advantageously low drive currents in actuator applications.

In further embodiments, the alloy has a cobalt content of 14% by weight≦Co≦22% by weight and 14% by weight≦Co≦20% by weight.

The soft magnetic alloy of the magnet core has a chromium and manganese content which results in a higher resistivity p in the annealed state accompanied by a slight reduction of saturation. This higher resistivity allows shorter switching times in an actuator, because eddy currents are reduced. At the same time, the alloy has a high saturation and a high permeability $\mu_{max}$, whereby good soft magnetic properties are maintained.

The alloy elements Si and Al improve the strength of the alloy without significantly reducing its soft magnetic properties. By the addition of Si and Al, the strength of the alloy can be increased noticeably as a result of solid-solution hardening without any significant reduction of its soft magnetic properties.

The aluminium content and the vanadium content according to the invention permit a higher annealing temperature, which improves the soft magnetic properties of coercitive field strength $H_c$ and maximum permeability $\mu_{max}$. A high permeability is desirable, because it results in low drive currents if the alloy is used as a magnet core or flux conductor of an actuator.

In one embodiment, the alloy has a silicon content of 0.5% by weight≦Si≦1.0% by weight.

The Mo content was kept low to avoid the formation of carbides, which may adversely affect magnetic properties.

In addition of Cr and Mn, a minor addition of molybdenum is expedient, as this molybdenum content is characterised by an advantageous relationship between resistance increase and saturation reduction.

One embodiment has an aluminium plus silicon content of 0.6% by weight≦Al+Si≦1.5% by weight, whereby the brittleness and processing problems which may arise at a higher total aluminium plus silicon content are avoided.

One embodiment has a chromium plus manganese plus molybdenum plus aluminium plus silicon plus vanadium content of 4.0% by weight≦(Cr+Mn+Mo+Al+Si+V)≦9.0% by weight. Compared to the binary Co—Fe alloy, this alloy has a higher resistivity, resulting in a suppression of eddy currents, while saturation polarisation is reduced only minimally and coercitive field strength $H_c$ is increased even less.

One embodiment has a chromium plus manganese plus molybdenum plus aluminium plus silicon plus vanadium content of 6.0% by weight≦Cr+Mn+Mo+Al+Si+V≦9.0% by weight.

In further embodiments, the soft magnetic alloy consists essentially of 10% by weight≦Co≦22% by weight, 0% by weight≦V≦1% by weight, 1.5% by weight≦Cr≦3% by weight, 1% by weight≦Mn≦2% by weight, 0% by weight≦Mo≦1% by weight, 0.5% by weight≦Si≦1.5% by weight, 0.1% by weight≦Al≦1.0% by weight, rest iron. It may have an aluminium plus silicon content of 0.6% by weight≦Al+Si≦1.5% by weight and/or a chromium plus manganese plus molybdenum plus aluminium plus silicon plus vanadium content of 4.5% by weight≦Cr+Mn+Mo+Al+Si+V≦6.0% by weight.

In one embodiment, the alloy consists essentially of V=0% by weight, 1.6% by weight≦Cr≦2.5% by weight, 1.25% by weight≦Mn≦1.5% by weight, 0% by weight≦Mo≦0.02% by weight, 0.6% by weight≦Si≦0.9% by weight and 0.2% by weight≦Al≦0.7% by weight.

In one embodiment, the alloy consists essentially of 0% by weight≦V≦2.0% by weight, 1.6% by weight≦Cr≦2.5% by weight, 1.25% by weight≦Mn≦1.5% by weight, 0% by weight≦Mo≦0.02% by weight, 0.6% by weight≦Si≦0.9% by weight and 0.2% by weight≦Al≦0.7% by weight.

In one embodiment, the alloy consists essentially of 0% by weight≦V≦0.01% by weight, 2.3% by weight≦Cr≦3.5% by weight, 1.25% by weight≦Mn≦1.5% by weight, 0.75% by weight≦Mo≦1% by weight, 0.6% by weight≦Si≦0.9% by weight and 0.1% by weight≦Al≦0.2% by weight.

In one embodiment, the alloy consists essentially of 0.75% by weight≦V≦2.75% by weight, 2.3% by weight≦Cr≦3.5% by weight, 1.25% by weight≦Mn≦1.5% by weight, 0% by weight≦Mo≦0.01% by weight, 0.6% by weight≦Si≦0.9% by weight and 0.2% by weight≦Al≦1.0% by weight.

These three alloys offer a preferred combination of high electric resistance, high saturation and low coercitive field strength.

Alloys of the above compositions have a resistivity ρ>0.50 μΩm or ρ>0.55 μΩm or ρ>0.60 μΩm or ρ>0.65 μΩm. This value provides for an alloy which generates low eddy currents when used as a magnet core of an actuator system. This permits the use of the alloy in actuator systems with higher switching times.

The proportion of the elements aluminium and silicon in the alloy according to the invention results in an alloy with a yield point of $R_{p0.2}$ of 340 MPa. This higher strength of the alloy can increase its service life when used as a magnet core of an actuator system. This is an attractive feature when using the alloy in high-frequency actuator systems, such as fuel injectors in internal combustion-engines.

The alloy according to the invention is characterised by good magnetic properties, high strength and high resistivity. In further embodiments, the alloy has a saturation J(400 A/cm)>2.00 T or >1.90 T and/or a coercitive field strength $H_c$<3.5 A/cm or $H_c$<2.0 cm and/or $H_c$<1.0 cm and a maximum permeability $\mu_{max}$>1000 or $\mu_{max}$>2000.

The chromium plus manganese plus molybdenum plus aluminium plus silicon plus vanadium content according to the invention lies in the range of 4.0% by weight to 9.0% by weight. This higher content provides for an alloy having a higher electric resistance ρ>0.6 μΩm and a low coercitive field strength $H_c$<2.0 A/cm. This combination of properties is particularly suitable for use in high-speed actuators.

The invention further provides for a soft magnetic core or flux conductor for an electromagnetic actuator made of an alloy according to any of the preceding embodiments. This soft magnetic core is available in various embodiments, such as a soft magnetic core for a solenoid valve of an internal combustion engine, a soft magnetic core for a fuel injector of an internal combustion engine, a soft magnetic core for a direct injector of a spark ignition engine or diesel engine or as a soft magnetic component for electromagnetic valve control, for example for inlet and outlet valves.

The various actuator systems, such as solenoid valves and fuel injectors, are subject to varying requirements in terms of strength and magnetic properties. These requirements can be met by selecting an alloy with a composition within the range described above.

The invention further provides for a fuel injector of an internal combustion engine with a component made of a soft magnetic alloy according to any of the preceding embodiments. In further embodiments, the fuel injector is a direct injector of a spark ignition engine or a direct injector of a diesel engine.

In further embodiments, the invention provides for a yoke part for an electromagnetic actuator, for a soft magnetic rotor and a soft magnetic stator for an electric motor and for a soft magnetic component for an electromagnetic valve control on an inlet valve or an outlet valve used in an engine compartment of, for example, a motor vehicle, all these being made of an alloy according to any of the preceding embodiments.

The invention further provides for a method for the production of semi-finished products from a cobalt-iron alloy, wherein melting and hot forming processes are first used to produce workpieces from a soft magnetic alloy consisting essentially of 10% by weight≦Co≦22% by weight, 0% by weight≦V≦4% by weight, 1.5% by weight≦Cr≦5% by weight, 1% by weight≦Mn≦2% by weight, 0% by weight≦Mo≦1% by weight, 0.5% by weight≦Si≦1.5% by weight, 0.1% by weight≦Al≦1.0% by weight, rest iron.

The alloy of the workpieces may alternatively have a composition according to any of the preceding embodiments.

The alloy can be melted using a variety of different methods. In theory, all commonly used technologies are feasible, including melting in the presence of air or by means of VIM (vacuum induction melting). An arc furnace or other inductive technologies can be used for this purpose. VOD (vacuum oxygen decarburisation), AOD (argon oxygen decarburisation) or ERP (electroslag remelting process) improves the quality of the product.

The VIM method is preferred for the production of the alloy, as it permits a more precise adjustment of the proportions of the alloy elements, and non-metallic inclusions in the solidified alloy are avoided more easily.

The melting process is followed by a variety of process steps depending on the semi-finished product to be produced.

In the production of strip from which components are subsequently punched, the ingot resulting from the melting process is first converted into a slab by blooming. The term blooming identifies the conversion of an ingot into a slab with a rectangular cross-section in a hot rolling process at a temperature of, for example, 1250° C. After the blooming process, the scale formed on the surface of the slab is removed by grinding. The grinding process is followed by a further hot rolling process in which the slab is converted into strip at a temperature of, for example, 1250° C. The impurities formed in the hot rolling process on the surface of the strip are then removed by grinding or pickling, and the strip is cold-rolled to its final thickness, which may be in the range of 0.1 mm to 2 mm. Finally, the strip is subjected to a finish-annealing process. During this finish-annealing process, the lattice vacancies caused by the forming processes are rectified, and crystalline grains form in the structure.

The process for producing turned components is similar. Here, too, billets with a square cross-section are produced by blooming the ingot. This so-called blooming is performed at a temperature of, for example, 1250° C. The scale produced in the blooming process is then removed by grinding. This is followed by a further hot rolling process whereby the billets are converted into bars or wires up to a diameter of, for example, 13 mm. Straightening and scalping processes then correct distortions in the material on the one hand and remove the impurities formed on the surface in the hot rolling process on the other hand. The material is finally likewise finish-annealed.

The finish-annealing process can be carried out in a temperature range between 700° C. and 1100° C. In one implementation, the finish-annealing process is carried out in a temperature range between 750° C. and 850° C. The finish-annealing process can be carried out in the presence of an inert gas or hydrogen or in a vacuum.

Conditions such as the temperature and duration of the finish-annealing process can be selected such that the finish-annealed alloy in a tensile test exhibits deformation parameters of an elongation $A_L$>2% or $A_L$>20%.

In a further implementation, the alloy is cold-formed prior to finish-annealing.

The invention is explained in greater detail with reference to the drawing.

FIG. 1 shows an electromagnetic actuator-system 20 with a magnet core 21 made of a soft magnetic alloy according to the invention, which in a first embodiment consists essentially of 18.3% by weight Co, 2.62% by weight Cr, 1.37% by weight Mn, 0.85% by weight Si, 0.01% by weight Mo, 0.21% by weight Al, rest iron. In a further embodiment not illustrated in the drawing, a yoke made of this alloy is specified.

A coil 22 is supplied with power from a power source 23, so that a magnetic field is induced as the coil 22 is excited. The coil 22 is arranged around the magnet core 21 such that the magnet core 21 is moved from a first position 24 indicated by a broken line in FIG. 1 to a second position 25 by the induced magnetic field. In this embodiment, the first position 24 is a closed position while the second position is an open position. The current flow 26 through the channel 27 is therefore controlled by the actuator system 20.

In a further embodiment, the actuator system 20 is a fuel injector of a spark ignition engine or a diesel engine, or a direct injector of a spark ignition engine or a diesel engine.

The soft magnetic alloy of the magnet core 21 has a chromium plus manganese content resulting in the annealed state in a resistivity ρ of 0.572 μΩm. This higher resistivity allows for shorter switching times in the actuator, as eddy currents are reduced. At the same time, the alloy has a high saturation J(400 A/cm), measured at a magnetic field strength of 400 A/cm, of 2.137 T and a permeability $\mu_{max}$ of 1915, whereby good soft magnetic properties are maintained.

The alloy elements Si and Al improve the strength of the magnet core 21 without substantially affecting its soft magnetic properties. The yield point $R_{p0.2}$ of this alloy is 402 MPa. The aluminium content permits a higher annealing temperature, which results in good soft magnetic properties of a coercitive field strength $H_c$ of only 2.57 A/cm and a maximum permeability $\mu_{max}$ of 1915. A high permeability is desirable, because it results in lower drive currents when using the alloy as a magnet core of an actuator.

The Mo content was kept low to avoid the formation of carbides, which can lead to a deterioration of the magnetic properties.

Table 1 lists compositions of various exemplary alloys according to the invention.

Figure 2:
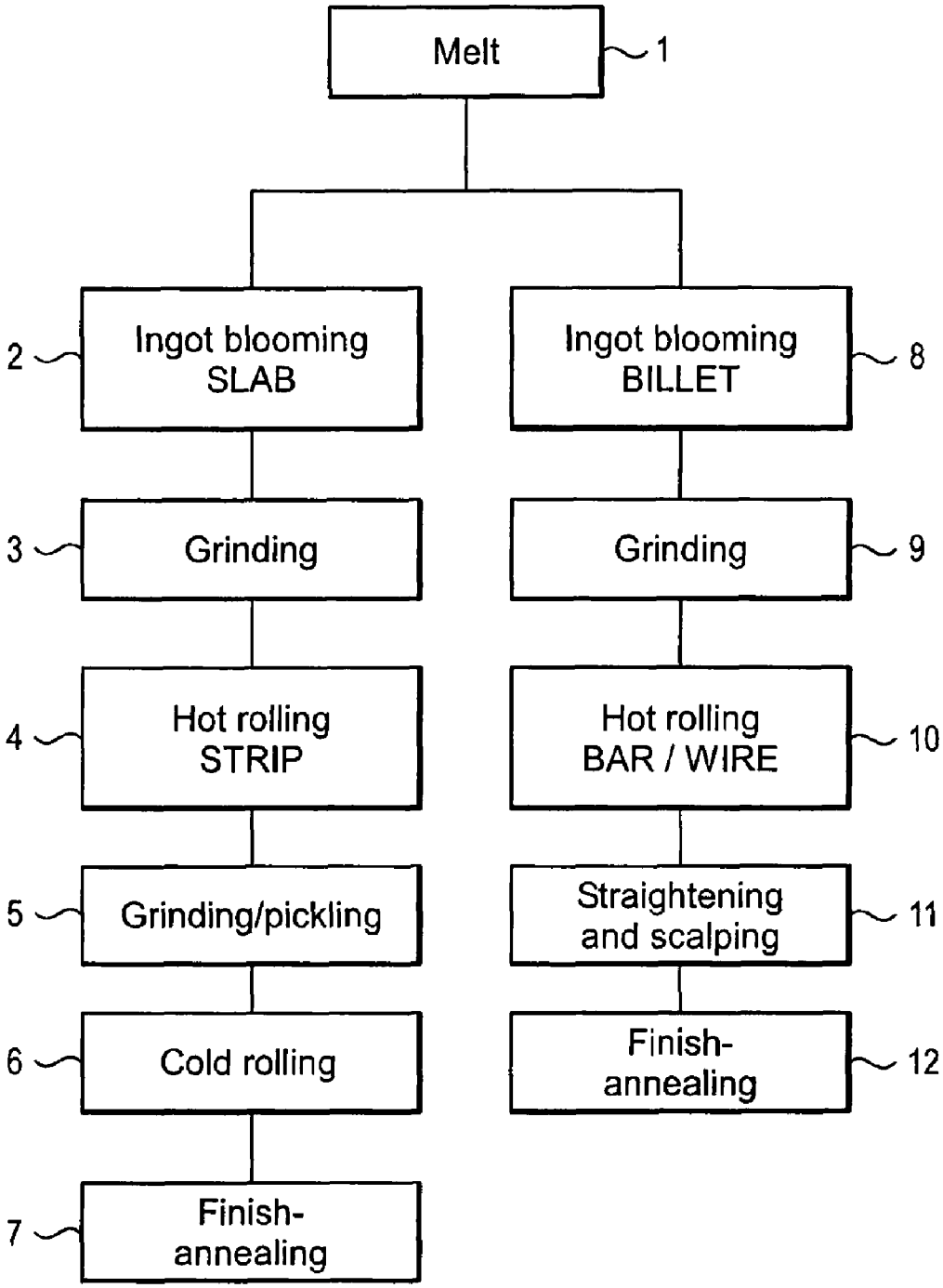
FIG. 2 is a flow chart showing steps in the production of semi-finished products made of an alloy according to an embodiment of the invention.

From these alloys, semi-finished products were made using a method illustrated in the flow chart of FIG. 2.

According to the flow chart of FIG. 2, the alloy is first subjected to a melting process 1.

Various methods can be used to melt the alloy. In theory, all commonly used technologies, such as melting in the presence of air or by means of VIM (vacuum induction melting), are feasible. Further possible technologies include the arc furnace or inductive technologies. VOD (vacuum oxygen decarburisation), AOD (argon oxygen decarburisation) or ERP (electroslag remelting process) improves the quality of the product.

The VIM method is preferred in the production of the alloy, as it permits a more precise adjustment of the proportions of the alloy elements, and non-metallic inclusions in the solidified alloy are avoided more easily.

Depending on the semi-finished product to be produced, the melting process is followed by a number of different process steps.

In the production of strip from which components are subsequently punched, the ingot resulting from the melting process 1 is first converted into a slab by blooming 2. The term blooming identifies the conversion of an ingot into a slab with a rectangular cross-section in a hot rolling process at a temperature of 1250° C. After the blooming process, the scale formed on the surface of the slab is removed by grinding 3. The grinding process 3 is followed by a further hot rolling process 4 in which the slab is converted into strip with a thickness of, for example, 3.5 mm at a temperature of 1250° C. The impurities formed in the hot rolling process on the surface of the strip are then removed by grinding or pickling 5, and the strip is cold-rolled 6 to its final thickness in the range of 0.1 mm to 2 mm. Finally, the strip is subjected to a finish-annealing process 7 at a temperature of >700° C. During this finish-annealing process, the lattice vacancies caused by the forming processes are rectified, and crystalline grains form in the structure.

The process for producing turned components is similar. Here, too, billets with a square cross-section are produced by blooming 8 the ingot. This so-called blooming is performed at a temperature of 1250° C. The scale produced in the blooming process 8 is then removed by grinding 9. This is followed by a further hot rolling process 10 whereby the billets are converted into bars or wires up to a diameter of 13 mm. Straightening and scalping processes 11 then correct distortions in the material on the one hand and remove the impurities formed on the surface in the hot rolling process 10 on the other hand. The material is finally likewise finish-annealed 12.

Figure 3:
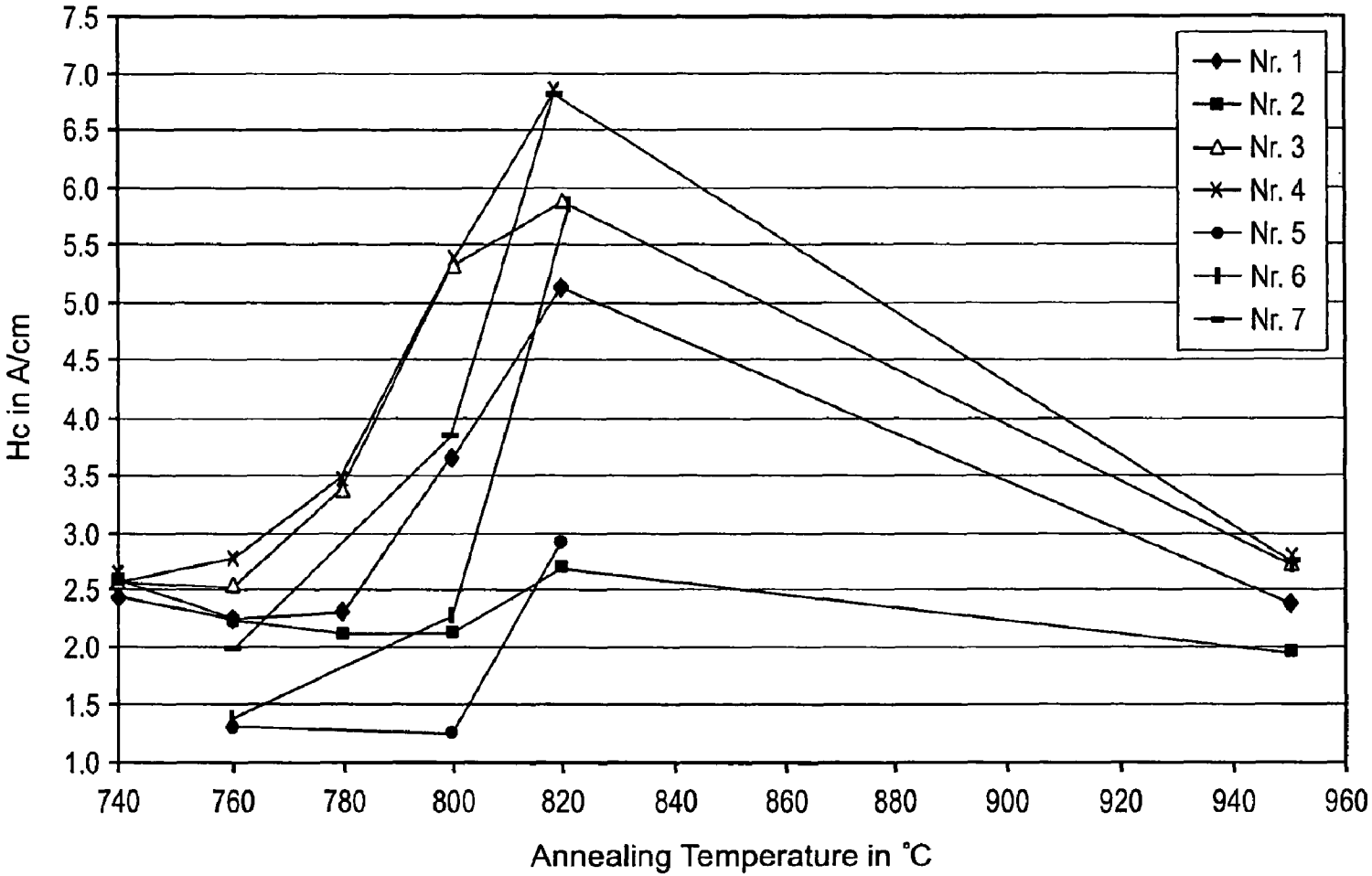
FIG. 3 is a graph showing coercitive field strength $H_c$ versus annealing temperature for various soft magnetic alloys according to certain embodiments of the invention.

The coercitive field strength $H_c$ was measured in dependence on annealing temperature for the alloys of Table 1. The results are illustrated in FIG. 3. As FIG. 3 shows, the coercitive field strength is initially reduced with rising temperature and then increases at even higher temperatures approaching the biphase region.

The selected annealing temperature is determined by composition, so that the coercitive field strength remains low. The alloy 3 described with reference to FIG. 1 was annealed at a temperature of 760° C.

Figure 4:
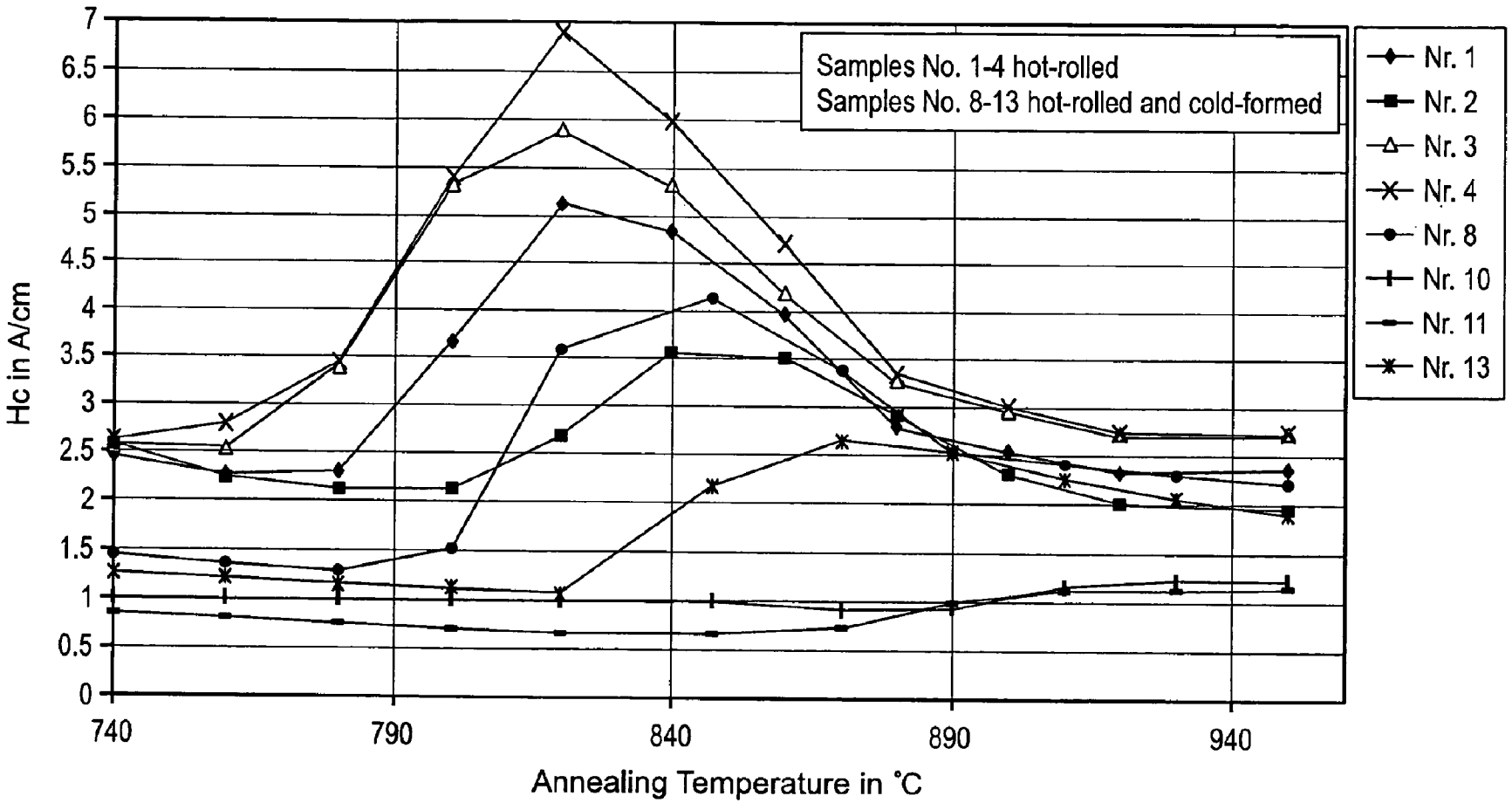
FIG. 4 is a graph showing coercitive field strength $H_c$ versus annealing temperature for further soft magnetic alloys according to certain embodiments of the invention.

FIG. 4 shows the coercitive field strength for the alloys 1 to 4, 8, 10, 11 and 13. The alloys 8, 10, 11 and 13 were cold-formed after hot rolling. The alloys 1 to 4 were hot-rolled only. FIG. 4 illustrates the effect of various added elements on $H_c$ at various temperatures. The increase of $H_c$ shows the upper limit of the ferritic phase.

The alloys 2, 10, 11 and 13 with a lower $H_c$ at higher annealing temperatures have an aluminium content of at least 0.68% by weight. The alloys 10 and 11 have a particularly low coercitive field strength $H_c$ of less than 1.5 A/cm at annealing temperatures above 850° C. These alloys have an aluminium content of 0.84% by weight and 0.92% by weight respectively and a vanadium content of 2.51% by weight and 1.00% by weight respectively.

In these alloys, the phase transition temperature becomes even higher. This offers the advantage that the magnetic properties can be improved even further by using a higher annealing temperature.

The following properties: resistivity in the annealed state $\rho_{el}$, coercitive field strength $H_c$, saturation J at a magnetic field strength of 160 A/cm, J(160 A/cm) and a magnetic field strength of 400 A/cm, J(400 A/cm), maximum permeability $\mu_{max}$, yield point $R_m$, $R_{p0.2}$, elongation AL and modulus of elasticity were measured for the alloys of Table 1 and are summarised in Table 2.

The resistivity p of each alloy lies above 0.5 μΩm. This results in a suppression of eddy currents, making the alloys suitable for application as actuators with short switching times. The yield point for the alloys 1 to 7 was measured in the finish-annealed state and lies above 340 MPa for each alloy. These alloys can therefore be used in applications involving higher mechanical loads.

Table 2 indicates that the alloys, notwithstanding the high proportion of non-magnetic elements added, have a high saturation J(400 A/cm)>2.0 T, a high resistivity ρ>0.5 μΩm and a high yield point $R_{p0.2}$, >340 MPa. These alloys are therefore particularly suitable for magnet cores in high-speed actuator systems, such as fuel injectors.

1st EMBODIMENT

An alloy according to a first embodiment consists essentially of 18.1% by weight Co, 2.24% by weight Cr, 1.40% by weight Mn, 0.01% by weight Mo, 0.83% by weight Si, 0.24% by weight Al, rest iron and was produced as described above. The alloy was annealed at 760° C. and in the annealed state has a resistivity $\rho_{el}$ of 0.542 μΩm, a coercitive field strength $H_c$ of 2.34 A/cm, a saturation J at a magnetic field strength of 160 A/cm, J(160 A/cm) of 2.029 T and at a magnetic field strength of 400 A/cm, J(400 A/cm) of 2.146 T, a maximum permeability $\mu_{max}$ of 2314, a yield point $R_m$ of 623 MPa, $R_{p0.2}$ of 411 MPa, an elongation AL of 29.6% and a modulus of elasticity of 220 GPa.

2nd EMBODIMENT

An alloy according to a second embodiment consists essentially of 18.2% by weight Co, 1.67% by weight Cr, 1.39% by weight Mn, 0.01% by weight Mo, 0.82% by weight Si, 0.68% by weight Al, rest iron and was produced as described above. The alloy was annealed at 800° C. and in the annealed state has a resistivity $\rho_{el}$ of 0.533 μΩm, a coercitive field strength $H_c$ of 1.94 A/cm, a saturation J at a magnetic field strength of 160 A/cm, J(160 A/cm) of 2.019 T and at a magnetic field strength of 400 A/cm, J(400 A/cm) of 2.151 T, a maximum permeability $\mu_{max}$ of 1815, a yield point $R_m$ of 661 MPa, $R_{p0.2}$ of 385 MPa, an elongation AL of 25.4% and a modulus of elasticity of 221 GPa.

3rd EMBODIMENT

An alloy according to a third embodiment consists essentially of 18.3% by weight Co, 2.62% by weight Cr, 1.37% by weight Mn, 0.01% by weight Mo, 0.85% by weight Si, 0.21% by weight Al, rest iron and was produced as described above. The alloy was annealed at 760° C. and in the annealed state has a resistivity $\rho_{el}$ of 0.572 μΩm, a coercitive field strength $H_c$ of 2.57 A/cm, a saturation J at a magnetic field strength of 160 A/cm, J(160 A/cm) of 2.021 T and at a magnetic field strength of 400 A/cm, J(400 A/cm) of 2.137 T, a maximum permeability $\mu_{max}$ of 1915, a yield point $R_m$ of 632 MPa, $R_{p0.2}$ of 402 MPa, an elongation AL of 28.0% and a modulus of elasticity of 217 GPa.

4th EMBODIMENT

An alloy according to a fourth embodiment consists essentially of 18.3% by weight Co, 2.42% by weight Cr, 1.45% by weight Mn, 0.01% by weight Mo, 0.67% by weight Si, 0.23% by weight Al, rest iron and was produced as described above. The alloy was annealed at 730° C. and in the annealed state has a resistivity $\rho_{el}$ of 0.546 μΩm, a coercitive field strength $H_c$ of 2.73 A/cm, a saturation J at a magnetic field strength of 160 A/cm, J(160 A/cm) of 2.037 T and at a magnetic field strength of 400 A/cm, J(400 A/cm) of 2.156 T, a maximum permeability $\mu_{max}$ of 2046, a yield point $R_m$ of 605 MPa, $R_{p0.2}$ of 395 MPa, an elongation AL of 29.5% and a modulus of elasticity of 223 GPa.

5th EMBODIMENT

An alloy according to a fifth embodiment consists essentially of 15.40% by weight Co, 2.34% by weight Cr, 1.27% by weight Mn, 0.85% by weight Si, 0.23% by weight Al, rest iron and was produced as described above. The alloy was annealed at 760° C. and in the annealed state has a resistivity $\rho_{el}$ of 0.5450 μΩm, a coercitive field strength $H_c$ of 1.30 A/cm, a saturation J at a magnetic field strength of 160 A/cm, J(160 A/cm) of 1.986 T and at a magnetic field strength of 400 A/cm, J(400 A/cm) of 2.105 T and a maximum permeability $\mu_{max}$ of 3241.

6th EMBODIMENT

An alloy according to a sixth embodiment consists essentially of 18.10% by weight Co, 2.30% by weight Cr, 1.37% by weight Mn, 0.83% by weight Si, 0.24% by weight Al, rest iron and was produced as described above. The alloy was annealed at 760° C. and in the annealed state has a resistivity $\rho_{el}$ of 0.5591 μΩm, a coercitive field strength $H_c$ of 1.39 A/cm, a saturation J at a magnetic field strength of 160 A/cm, J(160 A/cm) of 2.027 T and at a magnetic field strength of 400 A/cm, J(400 A/cm) of 2.138 T and a maximum permeability $\mu_{max}$ of 2869.

7th EMBODIMENT

An alloy according to a seventh embodiment consists essentially of 21.15% by weight Co, 2.31% by weight Cr, 1.38% by weight Mn, 0.84% by weight Si, 0.23% by weight Al, rest iron and was produced as described above. The alloy was annealed at 760° C. and in the annealed state has a resistivity $\rho_{el}$ of 0.5627 μΩm, a coercitive field strength $H_c$ of 1.93 A/cm, a saturation J at a magnetic field strength of 160 A/cm, J(160 A/cm) of 2.066 T and at a magnetic field strength of 400 A/cm, J(400 A/cm) of 2.165 T and a maximum permeability $\mu_{max}$ of 1527.

The eighth to thirteenth embodiments contain slightly more added elements in total, i.e. between 6 and 9% by weight. In the annealed state, these alloys have a resistivity $\rho_{el} \geqq 0.60$ μΩm.

8th EMBODIMENT

An alloy according to an eighth embodiment consists essentially of 18.0% by weight Co, 2.66% by weight Cr, 1.39% by weight Mn, 0.01% by weight Mo, 0.87% by weight Si, 0.17% by weight Al, 1.00% by weight V, rest iron and was produced as described above. This alloy was cold-formed after hot rolling. The alloy was annealed at 780° C. and in the annealed state has a resistivity $\rho_{el}$ of 0.627 μΩm, a coercitive field strength $H_c$ of 1.40 A/cm, a saturation J at a magnetic field strength of 160 A/cm, J(160 A/cm) of 1.977 T and at a magnetic field strength of 400 A/cm, J(400 A/cm) of 2.088 T, a maximum permeability $\mu_{max}$ of 2862, a yield point $R_m$ of 605 MPa, $R_{p0.2}$ of 374 MPa, an elongation AL of 29.7% and a modulus of elasticity of 222 GPa.

9th EMBODIMENT

An alloy according to a ninth embodiment consists essentially of 18.0% by weight Co, 2.60% by weight Cr, 1.35% by weight Mn, 0.99% by weight Mo, 0.84% by weight Si, 0.17% by weight Al, ≦0.01% by weight V, rest iron and was produced as described above. This alloy was cold-formed in addition. The alloy was annealed at 780° C. and in the annealed state has a resistivity $\rho_{el}$ of 0.604 μΩm, a coercitive field strength $H_c$ of 2.13 A/cm, a saturation J at a magnetic field strength of 160 A/cm, J(160 A/cm) of 1.969 T and at a magnetic field strength of 400 A/cm, J(400 A/cm) of 2.092 T, a maximum permeability $\mu_{max}$ of 1656, a yield point $R_m$ of 636 MPa, $R_{p0.2}$ of 389 MPa, an elongation AL of 29.2% and a modulus of elasticity of 222 GPa.

10th EMBODIMENT

An alloy according to a tenth embodiment consists essentially of 18.0% by weight Co, 1.85% by weight Cr, 1.33% by weight Mn, ≦0.01% by weight Mo, 0.86% by weight Si, 0.84% by weight Al, 2.51% by weight V, rest iron and was produced as described above. This alloy was then cold-formed. The alloy was annealed at 870° C. and in the annealed state has a resistivity $\rho_{el}$ of 0.716 μΩm, a coercitive field strength $H_c$ of 0.95 A/cm, a saturation J at a magnetic field strength of 160 A/cm, J(160 A/cm) of 1.920 T and at a magnetic field strength of 400 A/cm, J(400 A/cm) of 2.015 T and a maximum permeability $\mu_{max}$ of 4038.

This alloy of the tenth embodiment offers a particularly advantageous combination of a high resistivity $\rho_{el}$ of 0.716 μΩm, a low coercitive field strength $H_c$ of 0.95 A/cm and a high saturation J at a magnetic field strength of 160 A/cm, J(160 A/cm) of 1.920 T.

11th EMBODIMENT

An alloy according to an eleventh embodiment consists essentially of 12.0% by weight Co, 2.65% by weight Cr, 1.38% by weight Mn, ≦0.01% by weight Mo, 0.85% by weight Si, 0.92% by weight Al, 1.00% by weight V, rest iron and was produced as described above and then cold-formed. The alloy was annealed at 820° C. and in the annealed state has a resistivity $\rho_{el}$ of 0.658 μΩm, a coercitive field strength $H_c$ of 0.72 A/cm, a saturation J at a magnetic field strength of 160 A/cm, J(160 A/cm) of 1.880 T and at a magnetic field strength of 400 A/cm, J(400 A/cm) of 2.008 T, a maximum permeability $\mu_{max}$ of 5590, a yield point $R_m$ of 525 MPa, $R_{p0.2}$ of 346 MPa, an elongation AL of 33.5% and a modulus of elasticity of 216 GPa.

This alloy of the eleventh embodiment offers a particularly advantageous combination of a high resistivity $\rho_{el}$ of 0.658 μΩm, a low coercitive field strength $H_c$ of 0.72 A/cm and a high saturation J at a magnetic field strength of 160 A/cm, J(160 A/cm) of 1.880 T.

12th EMBODIMENT having a Co content of more than 22% by weight, the twelfth alloy does not correspond to the invention.

13th EMBODIMENT

An alloy according to a thirteenth embodiment consists essentially of 18.0% by weight Co, 3.00% by weight Cr, 1.32% by weight Mn, <0.01% by weight Mo, 0.86% by weight Si, 0.84% by weight Al, 2.01% by weight V, rest iron and was produced as described above and then cold-formed after hot rolling. The alloy was annealed at 820° C. and in the annealed state has a resistivity $\rho_{el}$ of 0.769 μΩm, a coercitive field strength $H_c$ of 1.14 A/cm, a saturation J at a magnetic field strength of 160 A/cm, J(160 A/cm) of 1.896 T and at a magnetic field strength of 400 A/cm, J(400 A/cm) of 1.985 T, a maximum permeability $\mu_{max}$ of 3499, a yield point $R_m$ of 674 MPa, $R_{p0.2}$ of 396 MPa, an elongation AL of 33.3% and a modulus of elasticity of 218 GPa.

TABLE 1

| Alloy | Fe | Co (% by weight) | Total added alloys | Cr (% by weight) | Mn (% by weight) | Si (% by weight) | Mo (% by weight) | Al (% by weight) | V (% by weight) |
|---|---|---|---|---|---|---|---|---|---|
| 1 | Rest | 18.1 | 4.73 | 2.24 | 1.40 | 0.83 | 0.01 | 0.24 | <0.01 |
| 2 | Rest | 18.2 | 4.58 | 1.67 | 1.39 | 0.82 | 0.01 | 0.68 | <0.01 |
| 3 | Rest | 18.3 | 5.09 | 2.62 | 1.37 | 0.85 | 0.01 | 0.21 | <0.01 |
| 4 | Rest | 18.3 | 4.78 | 2.42 | 1.45 | 0.67 | 0.01 | 0.23 | <0.01 |
| 5 | Rest | 15.40 | 4.69 | 2.34 | 1.27 | 0.85 | 0.001 | 0.23 | <0.01 |
| 6 | Rest | 18.10 | 4.74 | 2.30 | 1.37 | 0.83 | 0.001 | 0.24 | <0.01 |
| 7 | Rest | 21.15 | 4.76 | 2.31 | 1.38 | 0.84 | 0.001 | 0.23 | <0.01 |
| 8 | Rest | 18.0 | 6.18 | 2.66 | 1.39 | 0.87 | <0.01 | 0.17 | 1.00 |
| 9 | Rest | 18.0 | 6.18 | 2.60 | 1.35 | 0.84 | 0.99 | 0.17 | <0.01 |
| 10 | Rest | 18.0 | 7.38 | 1.85 | 1.33 | 0.86 | <0.01 | 0.84 | 2.51 |
| 11 | Rest | 12.0 | 6.78 | 2.65 | 1.38 | 0.85 | <0.01 | 0.92 | 1.00 |
| 12* | Rest | 25.0 | 5.58 | 1.57 | 0.96 | 0.93 | <0.01 | 1.02 | 1.00 |
| 13 | Rest | 18.0 | 8.18 | 3.00 | 1.32 | 0.86 | <0.01 | 0.84 | 2.01 |

*not according to invention

TABLE 2

| Alloy | Annealing Temperature (° C.) | ρ (μΩm) | $H_c$ (A/cm) | J(160) (T) | J(400) (T) | $\mu_{max}$ | $R_m$ (Mpa) | $Rp_{0.2}$ (Mpa) | AL (%) | Mod. of Elasticity (Gpa) |
|---|---|---|---|---|---|---|---|---|---|---|
| 1 | 760 | 0.542 | 2.34 | 2.029 | 2.146 | 2314 | 623 | 411 | 29.6 | 220 |
| 2 | 800 | 0.533 | 1.94 | 2.019 | 2.151 | 1815 | 661 | 385 | 25.4 | 221 |
| 3 | 760 | 0.572 | 2.57 | 2.021 | 2.137 | 1915 | 632 | 402 | 28.0 | 217 |
| 4 | 730 | 0.546 | 2.73 | 2.037 | 2.156 | 2046 | 615 | 395 | 29.5 | 223 |
| 5 | 760 | 0.545 | 1.30 | 1.986 | 2.105 | 3241 | — | — | — | — |
| 6 | 760 | 0.559 | 1.39 | 2.027 | 2.138 | 2869 | — | — | — | — |
| 7 | 760 | 0.563 | 1.93 | 2.066 | 2.165 | 1527 | — | — | — | — |
| 8 | 780 | 0.627 | 1.40 | 1.977 | 2.088 | 2862 | 605 | 374 | 29.7 | 222 |
| 9 | 780 | 0.604 | 2.13 | 1.969 | 2.092 | 1656 | 636 | 389 | 29.2 | 222 |
| 10 | 870 | 0.716 | 0.95 | 1.920 | 2.015 | 4038 | — | — | — | — |
| 11 | 820 | 0.658 | 0.72 | 1.880 | 2.008 | 5590 | 525 | 346 | 33.5 | 216 |
| 12* | 870 | 0.628 | 1.25 | 1.989 | 2.075 | 1793 | — | — | — | — |
| 13 | 820 | 0.769 | 1.14 | 1.896 | 1.985 | 3499 | 674 | 396 | 33.3 | 218 |

*not according to invention

The invention claimed is:

1. A soft magnetic alloy, consisting essentially of components given by the following ranges:

10% by weight≦Co≦22% by weight,
0% by weight≦V≦4% by weight,
1.5% by weight≦Cr≦5% by weight,
1% by weight≦Mn≦2% by weight,
0% by weight≦Mo≦1% by weight,
0.5% by weight≦Si≦1.5% by weight,
0.1% by weight≦Al≦1.0% by weight, and
the balance iron wherein the chromium plus manganese plus molybdenum plus aluminum plus silicon plus vanadium content is given by the range 4.0% by weight≦Cr+Mn+Mo+Al+Si+V≦9% by weight.

2. The soft magnetic alloy according to claim 1, wherein the cobalt content is given by the range 14% by weight≦Co≦22% by weight.

3. The soft magnetic alloy according to claim 2, wherein the cobalt content is given by the range 14% by weight≦Co≦20% by weight.

4. The soft magnetic alloy according to claim 1, wherein the vanadium content is given by the range 0% by weight≦V≦2% by weight.

5. The soft magnetic alloy according to claim 1, wherein the molybdenum content is given by the range 0% by weight≦Mo≦0.5% by weight.

6. The soft magnetic alloy according to claim 1, wherein the manganese content is given by the range of 1.25% by weight≦Mn≦1.5% by weight.

7. The soft magnetic alloy according to claim 1, wherein the silicon content is given by the range 0.5% by weight≦Si≦1.0% by weight.

8. The soft magnetic alloy according to claim 1, wherein the aluminium plus silicon content is given by the range 0.6% by weight≦Al+Si≦2% by weight.

9. A soft magnetic alloy, consisting essentially of components given by the following ranges:

10% by weight≦Co≦22% by weight,
0% by weight≦V≦2.0% by weight,
1.6% by weight≦Cr≦2.5% by weight,
1.25% by weight≦Mn≦1.5% by weight,
0% by weight≦Mo≦0.02% by weight,
0.6% by weight≦Si≦0.9% by weight,
0.2% by weight≦Al≦0.7% by weight, and
the balance iron.

10. A soft magnetic alloy, consisting essentially of components given by the following ranges:

10% by weight≦Co≦22% by weight,
0% by weight≦V≦0.01% by weight,
2.3% by weight≦Cr≦3.0% by weight,
1.25% by weight≦Mn≦1.5% by weight,
0.75% by weight≦Mo≦1% by weight,
0.6% by weight≦Si≦0.9% by weight,
0.1% by weight≦Al≦0.2% by weight, and
the balance iron.

11. A soft magnetic alloy consisting essentially of given by the following ranges:

10% by weight≦Co≦22% by weight,
0.75% by weight≦V≦2.75% by weight, 2.3% by weight≦Cr≦3.5% by weight,
1.25% by weight≦Mn≦1.5% by weight,
0% by weight≦Mo≦0.01% by weight,
0.6% by weight≦Si≦0.9% by weight,
0.7% by weight≦Al≦1.0% by weight, and
the balance iron.

12. The soft magnetic alloy according to claim 1, wherein after finish-annealing the alloy has an elongation $A_L$ >2% in a tensile test.

13. The soft magnetic alloy according to claim 1, wherein after finish-annealing the alloy has an elongation $A_L$ >20% in a tensile test.

14. The soft magnetic alloy according to claim 1, wherein the alloy has a resistivity ρ>0.50 μΩm.

15. The soft magnetic alloy according claim 14, wherein the alloy has a resistivity ρ>0.55 μΩm.

16. The soft magnetic alloy according to claim 15, wherein the alloy has a resistivity ρ>0.60 μΩm.

17. The soft magnetic alloy according to claim 16, wherein the alloy has a resistivity ρ>0.65 μΩm.

18. The soft magnetic alloy according to claim 1, wherein the alloy has a yield point $R_{p0.2}$ >340 MPa.

19. The soft magnetic alloy according to claim 1, wherein the alloy has a saturation J(400 A/cm) >1.90 T.

20. The soft magnetic alloy according to claim 19, wherein the alloy has a saturation J(400 A/cm) >2.00 T.

21. The soft magnetic alloy according to claim 1, wherein the alloy has a coercitive field strength $H_c$ <3.5 A/cm.

22. The soft magnetic alloy according to claim 21, wherein the alloy has a coercitive field strength $H_c$ <2.0 A/cm.

23. The soft magnetic alloy according to claim 1, wherein the alloy has a maximum permeability $\mu_{max}$>1000.

24. The soft magnetic alloy according to claim 23, wherein the alloy has a maximum permeability $\mu_{max}$ >2000.

25. A soft magnetic core for an electromagnetic actuator, comprising an alloy according to claim 1.

26. The soft magnetic core of claim 25, wherein the electromagnetic actuator is a solenoid valve of an internal combustion engine.

27. The soft magnetic core of claim 25, wherein the electromagnetic actuator is a fuel injector of an internal combustion engine.

28. The soft magnetic core of claim 27, wherein the electromagnetic actuator is a direct injector of a spark ignition engine.

29. The soft magnetic core of claim 27, wherein the electromagnetic actuator is a direct injector of a diesel engine.

30. A fuel injector of an internal combustion engine, comprising at least one component comprising a soft magnetic alloy according to claim 1.

31. The fuel injector according to claim 30, wherein the fuel injector is a direct injector of a spark ignition engine.

32. The fuel injector according to claim 30, wherein the fuel injector is a direct injector of a diesel engine.

33. A soft magnetic rotor for an electric motor, comprising an alloy according to claim 1.

34. A soft magnetic stator for an electric motor, comprising an alloy according to claim 1.

35. An electric motor comprising a soft magnetic stator or a soft magnetic rotor comprising an alloy according to claim 1.

36. A soft magnetic component for an electromagnetic valve control on an inlet valve or an outlet valve an engine compartment, comprising an alloy according to claim 1.

37. A yoke part for an electromagnetic actuator, comprising an alloy according to claim 1.

38. The yoke part according to claim 37, wherein the electromagnetic actuator comprises a solenoid valve.

39. An electromagnetic actuator comprising a core or yoke part comprising an alloy according to claim 1.

40. An electromagnetic valve control, comprising a soft magnetic component comprising an alloy according to claim 1.

41. The alloy according to claim 1, wherein the amounts of nitrogen, carbon, and oxygen impurities are 200 ppm or less, 400 ppm or less, and 100 ppm or less, respectively.

* * * * *